US005462300A

United States Patent [19]

Chien

[11] Patent Number: 5,462,300

[45] Date of Patent: Oct. 31, 1995

[54] GO-CART RESTRAINER

[75] Inventor: Jui-Lung Chien, Taichung, Taiwan

[73] Assignee: Jina Manufacturer Thai Co., Ltd., Bangkok, THX

[21] Appl. No.: 304,862

[22] Filed: Sep. 13, 1994

[51] Int. Cl.[6] ..... B62B 9/08

[52] U.S. Cl. ..... 280/87.051; 280/43.24; 188/5

[58] Field of Search ..... 280/87.051, 43.24, 280/302; 297/5; 482/66; 16/32, 34; 292/62, 80, 165

[56] References Cited

U.S. PATENT DOCUMENTS

| | | | |
|---|---|---|---|
| 3,090,634 | 5/1963 | Hesketh et al. | 280/43.24 |
| 3,889,964 | 6/1975 | Pitts, Jr. | 280/43.24 |
| 3,917,203 | 11/1975 | Heubeck et al. | 280/43.24 |
| 4,844,209 | 7/1989 | Sedlack | 280/87.051 |
| 5,080,383 | 1/1992 | Hsieh | 280/87.051 |
| 5,203,581 | 4/1993 | Jankowski | 280/87.051 |

*Primary Examiner*—Kenneth R. Rice
*Assistant Examiner*—Carla Mattix
*Attorney, Agent, or Firm*—William E. Pelton

[57] ABSTRACT

A go-cart includes a base, a plurality of wheels attached to the base and a restrainer operatively linked thereto the base for restraining the go-cart, wherein the restrainer includes two stands each including a shaft pivotably linked to the base of the go-cart and two feet projecting from the shaft. The feet are pivotable between a horizontal position for engaging the wheels with the ground and a vertical position for disengaging the wheels from the ground. The restrainer includes a device for retaining the feet in either of the vertical position or the horizontal position.

8 Claims, 4 Drawing Sheets

GO-CART RESTRAINER

BACKGROUND OF THE INVENTION

This invention relates to a go-cart restrainer.

Go-carts are useful for helping children learn how to walk and are useful for protecting them in that process. However, if the children are not carefully looked after they may go to some dangerous places while they are sitting in the go-carts. Therefore, go-carts have to be restrained sometimes.

SUMMARY OF THE INVENTION

It is the primary objective of this invention to provide a go-cart restrainer.

The primary objective of this invention is achieved by providing a go-cart restrainer. Such a go-cart includes a base and plurality of wheels attached to the base. The restrainer includes two stands each including a shaft pivotably linked to the base of the go-cart and two feet projecting from the shaft. The feet are pivotable between a horizontal position for engaging wheels with the ground and a vertical position for disengaging the wheels from the ground. The restrainer includes a device for retaining the feet in either of the vertical position and the horizontal position.

DETAILED DESCRIPTION OF THE EMBODIMENTS

Figure 1:
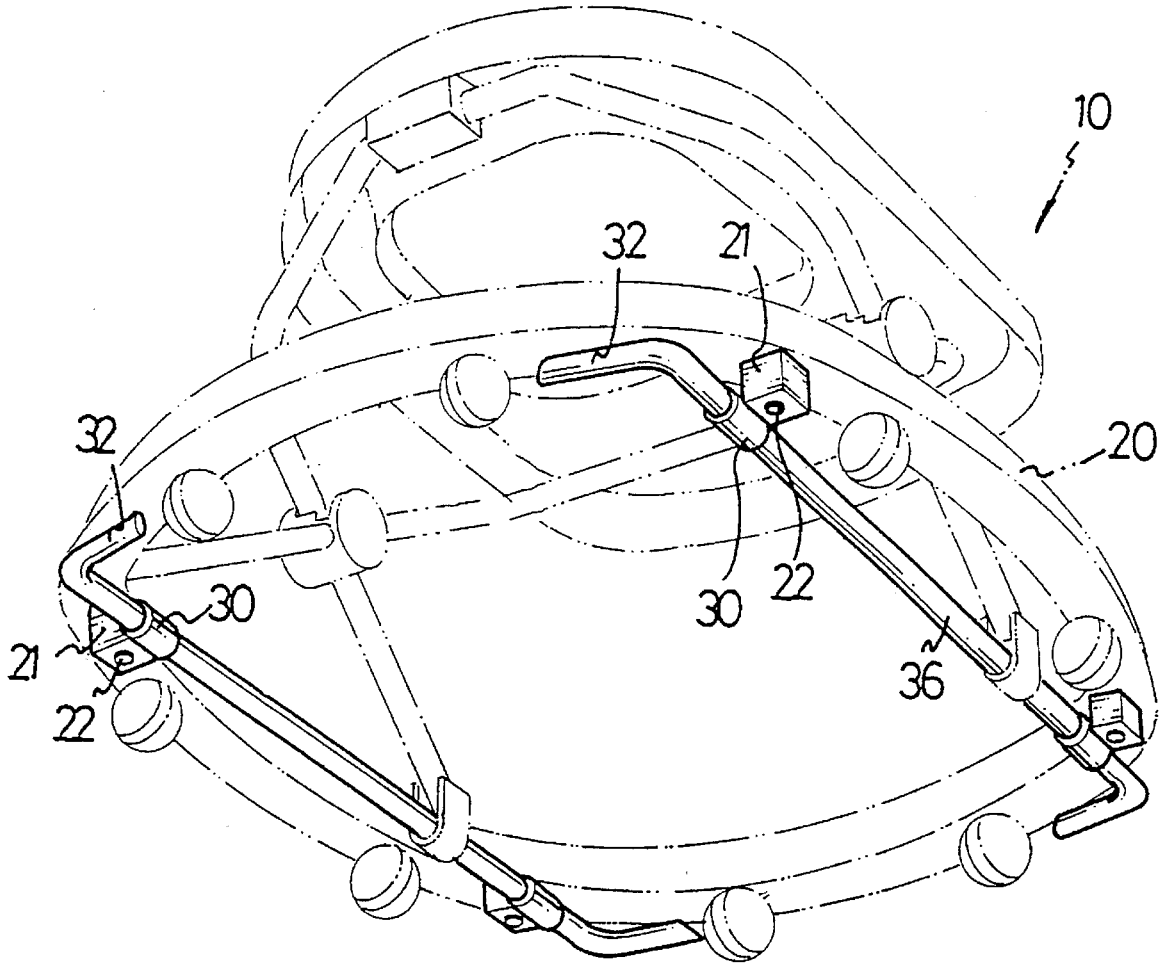
FIG. 1 is a bottom-front-right perspective view of a first embodiment of a go-cart restrainer according to this invention.

Referring to FIG. 1, a go-cart 10 is shown (in phantom lines) in order to show how the go-cart 10 is connected to a first embodiment of a go-cart restrainer according to this invention (shown in bold lines). The go-cart 10 includes an annular base 20. The go-cart restrainer includes two stands (not shown) each including a shaft 36 and two feet 32 projecting perpendicularly from the shaft. Each of the shafts 36 is insertable through two collars 30 which are secured to the annular base 20 of the go-cart 10 so that each of the stands is pivotably connected with the annular base 20 of the go-cart 10. Four boxes 21 are attached to the annular base 20 of the go-cart 10. Each of the boxes 21 is besides each of the collars 30. A device is received in each of the boxes 21 for retaining each of the stands.

Figure 2:
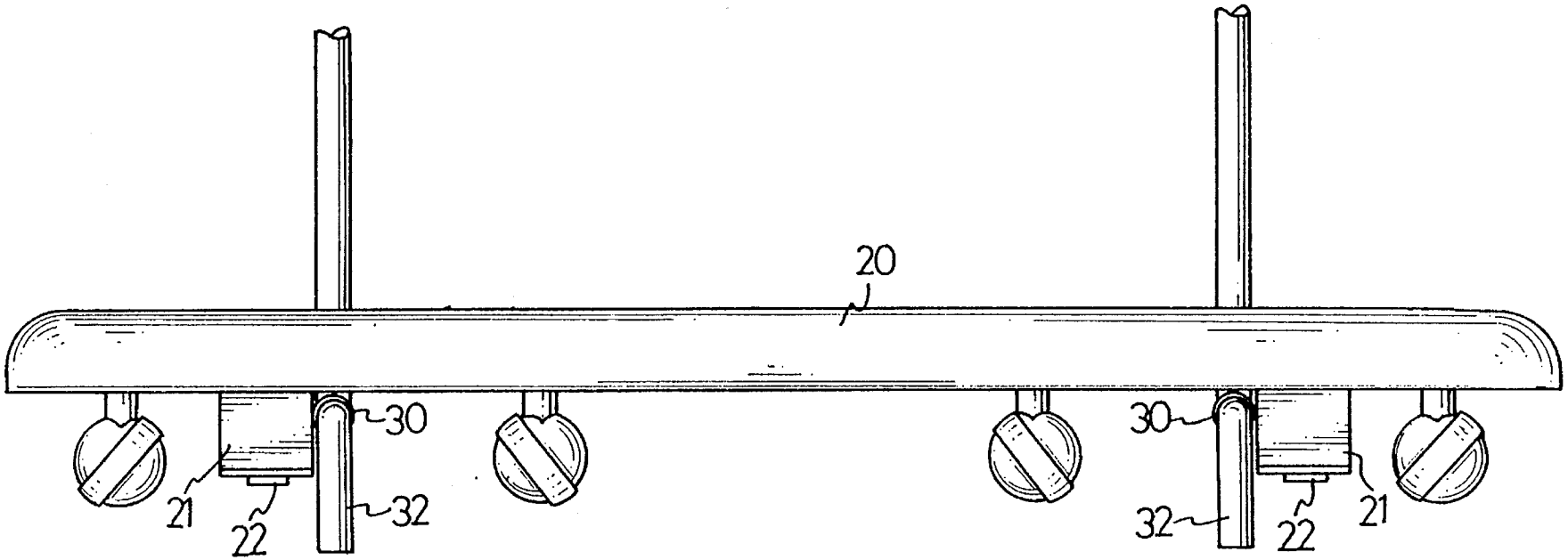
FIG. 2 is a side view of the first embodiment of the go-cart restrainer according to this invention.

Referring to FIG. 2, the feet 32 can be pivoted vertically. The height of the feet 32 is greater than that of the wheels 14 attached to the annular base 20 of the go-cart 10, therefore, the wheels 14 are disengaged from the ground and the go-cart is immobilized.

Figure 3:
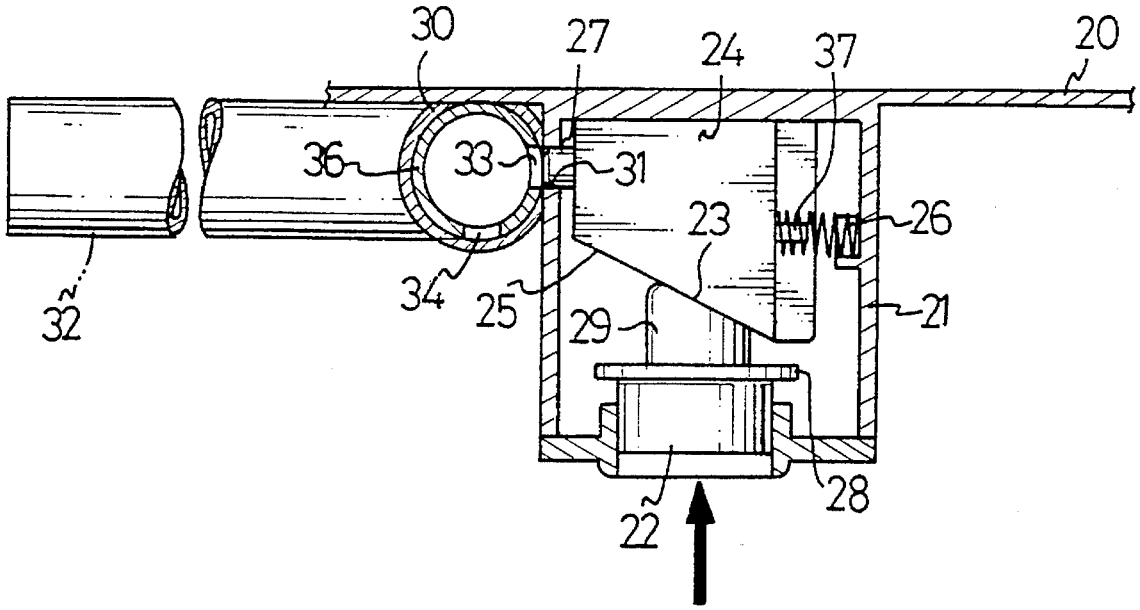
FIG. 3 is a cross-sectional view of the first embodiment of the go-cart restrainer according to this invention.
Figure 4:
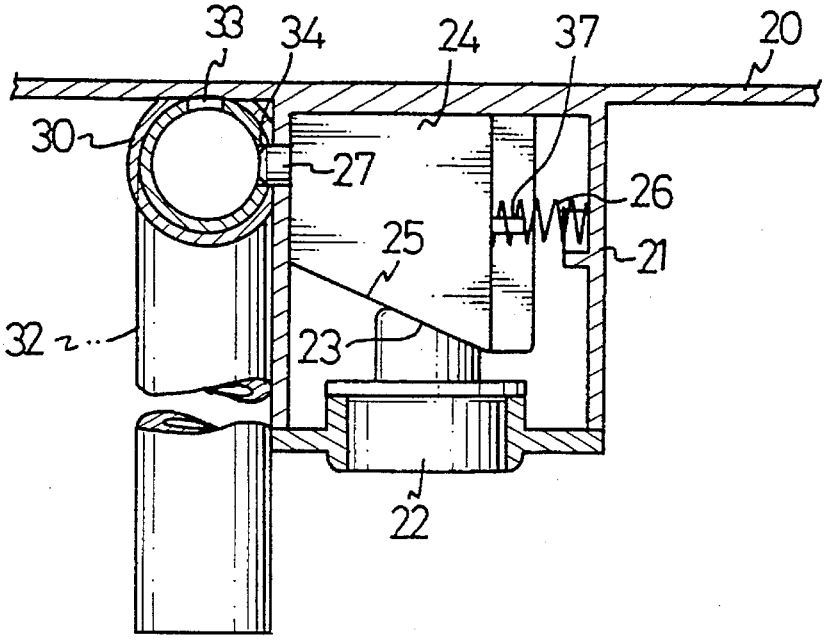
FIG. 4 is a cross-sectional view of the first embodiment of the go-cart restrainer according to this invention.

FIG. 3 shows a box 21, a collar 30 and a stand (36, 32) in a resting position. FIG. 4 shows a box 21, a collar 30 and a stand in a working position.

The box 21 is formed on a lower surface of the base 20 of the go-cart 10. The box 21 defines a bottom aperture (not numbered) and a lateral aperture (not numbered) facing the collar 30. A button 22 is receivable in the bottom aperture defined in the box 21. A flange 28 is formed on the button 22 for preventing ejection of the button 22 from the box 21. A protrusion 29 projects upwardly from the button 22. An inclined surface 23 is formed on the free end of the protrusion 29. A block 24 is received in the box 21. The block 24 includes an inclined surface 25 for matching the inclined surface 23. The block 24 includes a retainer 27 projecting laterally therefrom and a protrusion 37 projecting laterally therefrom. The retainer 27 and the protrusion 37 project in two opposite directions. The retainer 27 is insertable through the lateral aperture defined in the box 21. A spring 26 is mounted around the protrusion 37. The spring 26 is compressed between a wall of the box 24 and the block 24 for pushing the retainer 27 through the lateral aperture defined in the box 21. The inclined surfaces 23 and 25 are engageable with each other.

The collar 30 defines an aperture (not numbered) aligned with the lateral aperture defined in the box 21.

Two apertures 33 and 34 are defined in shaft 36. The apertures 33 and 34 are 90° from each other.

The button 22 can be pressed upwardly so as to retract the retainer 27 in the box 21 by means of the engagement between the inclined surfaces 23 and 25. The retainer 27 is disengaged from the aperture 33, thus allowing pivoting of the foot 32 from a horizontal position shown in FIG. 3 to a vertical position shown in FIG. 4. The button 22 will be released if the foot 32 is pivoted to the vertical position. The spring 26 pushes the retainer 27 into the aperture 34, thus retaining the foot 32 in the vertical position.

Figure 6:
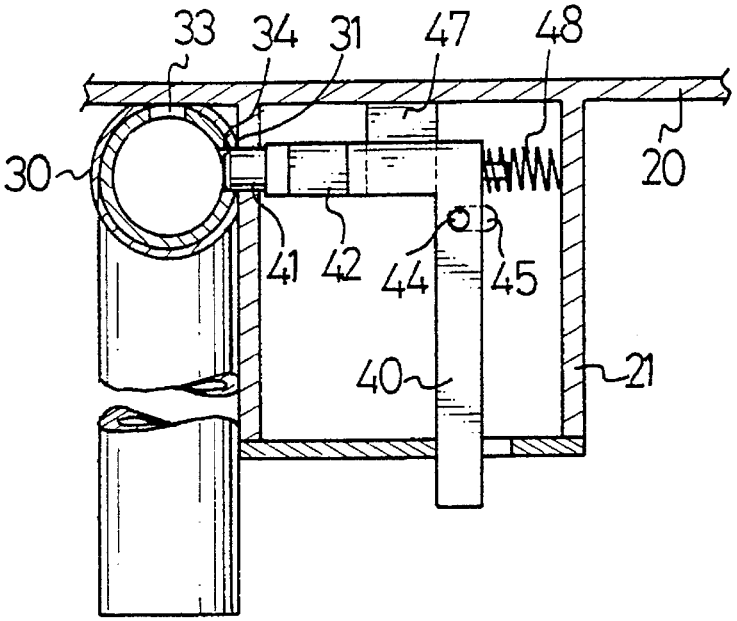
FIG. 6 is a cross-sectional view of the second embodiment of the go-cart restrainer according to this invention.
Figure 5:
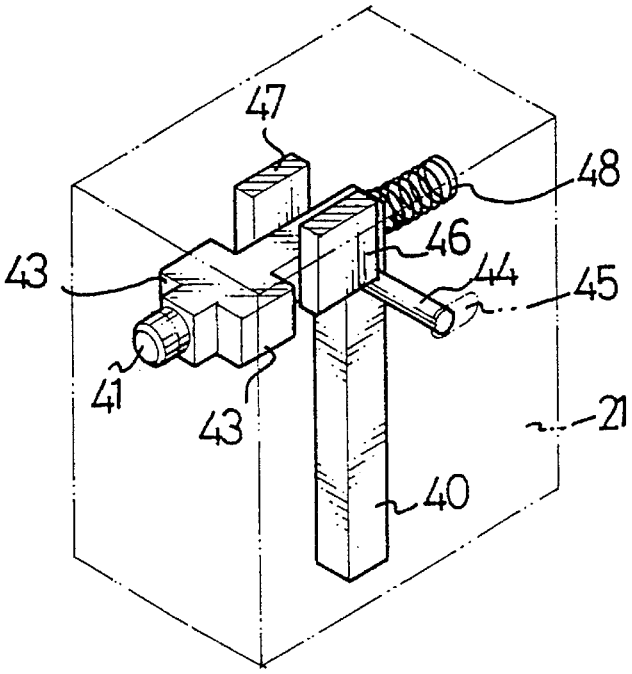
FIG. 5 is an isometric view of a second embodiment of the go-cart restrainer according to this invention.

FIGS. 5 and 6 show another embodiment of the go-cart restrainer according to this invention.

The box 21 defines a lateral aperture (not numbered), two lateral slots 45 and a bottom slot (not numbered). Two tabs 46 project downwardly from the annular base 20. The tabs 46 are located in the box 21. A retainer 41 projects from a first end of a bolt 42. The retainer 41 is insertable through the lateral aperture defined in the box 21. Two shoulders 43 project laterally from the bolt 42. The bolt 42 is disposed between the tabs 46 so that the bolt 42 is slidable along a rectilinear path. A protrusion 49 projects from a second end of the bolt 42. A spring 48 is mounted on the protrusion 49. The spring 48 is compressed between a wall of the box 21 and the second end of the bolt 42. The spring 48 pushes the first end 41 of the bolt 42 from the box 21. A trigger-like element 40 projects laterally from the bolt 42. Two bars 44 project laterally from the trigger-like element 40. The bars 44 are insertable through the lateral slots 45. The trigger-like element 40 is insertable through the bottom slot. The first end 41 of the bolt 42 can be retracted in the box 21 by pulling the trigger-like element 40.

I claim:

1. A go-cart including a base, a plurality of wheels attached to the base and a restrainer operatively linked to the base for restraining the go-cart, wherein the restrainer comprises two stands each including a shaft pivotably linked to the base of the go cart, two feet projecting from the shaft so that the feet are pivotable between a horizontal position for engaging the wheels with the ground and a vertical position for disengaging the wheels from the ground and a device for retaining the feet in one of the vertical and horizontal positions, the retaining device comprising two pairs of collars each defining an aperture, two apertures defined in each of the shafts, two retainers slidably attached to the base of the go-cart, wherein the collars are secured to the base of the go-cart, wherein each of the shafts is pivotably insertable in one of the pairs of the collars, wherein each of the retainers is insertable through the aperture defined in one of the collars into one of the apertures defined in one of the shafts for retaining each of the feet in one of the horizontal and vertical positions.

2. A go-cart retainer in accordance with claim 1 including a driving device operatively linked to the retainer for driving the retainer.

3. A go-cart restrainer in accordance with claim 2 wherein the driving device includes a box which is formed on a lower surface of the base and defines a lateral aperture and a bottom aperture, a block from which the retainer projects laterally and which includes an inclined surface, a button insertable in the bottom aperture defined in the box, a protrusion projecting from the button and including an inclined surface matching the inclined surface of the block and a spring compressed between the block and a wall of the box for pushing the retainer through the lateral aperture defined in the box and the aperture defined in the collar into one of the apertures defined in the shaft, wherein the retainer is disengageable from the apertures defined in the shaft by pressing the button because of engagement between the inclined surfaces.

4. A go-cart restrainer in accordance with claim 3 including a protrusion projecting from the block, wherein the spring is mounted on the protrusion projecting from the block.

5. A go-cart restrainer in accordance with claim 2 wherein the driving device includes a box which is formed on a lower surface of the base and defines a lateral aperture, two lateral slots and a bottom slot, a bolt from which the retainer projects and which includes two bars projecting laterally therefrom, a rod projecting from the bolt and a spring compressed between the bolt and a wall of the box for pushing the retainer through the lateral aperture defined in the box and the aperture defined in the collar into one of the apertures defined in the shaft, wherein the bars are slidably receivable in the lateral slots, wherein the rod is insertable through the bottom slot, wherein the retainer is disengageable from the apertures defined in the shaft by pulling the rod.

6. A go-cart restrainer in accordance with claim 5 including two tabs projecting downwardly from the base of the go-cart wherein the bolt is located between the tabs.

7. A go-cart restrainer in accordance with claim 6 including two shoulders projecting laterally from the bolt, wherein the shoulders are engageable with the tabs.

8. A go-cart restrainer according to claim 5 including a protrusion projecting from the bolt, wherein the spring is mounted on the protrusion projecting from the bolt.

* * * * *